US009561675B2

(12) United States Patent
Todaka

(10) Patent No.: US 9,561,675 B2
(45) Date of Patent: Feb. 7, 2017

(54) PRINTING DEVICE, CONTROL METHOD OF A PRINTING DEVICE, AND A PROGRAM

(71) Applicant: Seiko Epson Corporation, Tokyo (JP)

(72) Inventor: Shingo Todaka, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 14/833,539

(22) Filed: Aug. 24, 2015

(65) Prior Publication Data

US 2016/0052316 A1 Feb. 25, 2016

(30) Foreign Application Priority Data

Aug. 22, 2014 (JP) ..... 2014-169489
Jun. 5, 2015 (JP) ..... 2015-114611

(51) Int. Cl.

| | |
|---|---|
| ***B41J 2/36*** | (2006.01) |
| ***B41J 29/38*** | (2006.01) |
| ***B41J 3/407*** | (2006.01) |
| *B41J 11/00* | (2006.01) |

(52) U.S. Cl.
CPC ..... *B41J 29/38* (2013.01); *B41J 3/4075* (2013.01); *B41J 11/0095* (2013.01)

(58) Field of Classification Search
CPC ..... B41J 29/38; B41J 3/4075; B41J 2/36; B41J 2/362; B41J 2/365; B41J 2/37
See application file for complete search history.

(56) References Cited

U.S. PATENT DOCUMENTS

2006/0171754 A1 8/2006 Takami et al.

FOREIGN PATENT DOCUMENTS

JP 09-249339 A 9/1997
JP 2006-212794 A 8/2006

*Primary Examiner* — Kristal Feggins
(74) *Attorney, Agent, or Firm* — Nutter McClennen & Fish LLP; John J. Penny, Jr.; Santiago Velez

(57) ABSTRACT

A control method of a printing device comprising setting a threshold value based on a first detection value and a second detection value acquired from a detector when a target object is in a first state; comparing the threshold value with a detection value acquired from the detector and determining whether the target object is in a first state or a second state; and setting the threshold value at a time when printing starts on the target object.

8 Claims, 6 Drawing Sheets

PRINTING DEVICE, CONTROL METHOD OF A PRINTING DEVICE, AND A PROGRAM

BACKGROUND

1. Technical Field

The present invention relates to a printing device, a control method of a printing device, and a program.

2. Related Art

Label printers that use roll paper having labels affixed at a regular interval to a continuous liner, and print on labels of the roller label paper, are known from the literature. Such label printers convey each label to a printing position for printing, peel the label from the liner with a peeler (a label separating mechanism), and then discharge the printed labels from a label exit.

If a printed label is not correctly peeled from the liner, or if the label discharged from the label exit is not removed by the user, conveyance problems may result from the liner being conveyed with the label still attached, or the label sticking in the label exit and causing a paper jam.

A detector may therefore be disposed on the downstream side of the printing position to detect if each label is correctly peeled or if the label was removed from the label exit.

Such label detectors are, however, normally located on the upstream side of the label exit, and when a photodetection unit is used as the detector, light noise from outside the label exit can cause detection errors.

JP-A-H09-249339 discloses technology for detecting whether paper is present in a printer having an optical sensor including an emitter and a detector. The printer detects the output level of the detector when the emitter is not emitting, adds a predetermined specific value to this detection level to set a threshold value, detects the output level of the detector when the emitter is emitting, and compares this detection level with the threshold value to determine if media is present.

The technology described in JP-A-H09-249339 acquires a detection result from which the effect of external light noise has been removed. However, because the effect of the external environment changes continuously due to aging and changes in the position or ambient environment of the label printer, appropriately detecting whether a label is present may not be possible depending on the actual operating environment where the label printer is used.

SUMMARY

The present invention is directed to solving this problem and provides a printing device, a control method of a printing device, and a program that set a threshold value appropriately to the ambient environment when printing and detect if a target object is present.

A control method of a printing device according to at least one embodiment of the invention comprises: setting a threshold value based on a first detection value and a second detection value acquired from a detector when a target object is in a first state; and comparing the threshold value with a detection value acquired from the detector and determining whether the target object is in a first state or a second state; the threshold value being set before starting printing to the target object.

By setting a new threshold value before printing starts, this aspect of the invention can set the threshold value to a value that is appropriate to the ambient environment when printing starts.

Preferably, the control method of a printing device according to another aspect of at least one embodiment of the invention also includes setting the threshold value after the printing device receives print data related to printing on the target object.

Thus, the threshold value can be set immediately before the printing device starts printing.

Further preferably in another aspect of at least one embodiment of the invention, the detector detects the target object at the exit of the target object from the conveyance path; the first state is when the target object is not at the detection position of the detector; and the second state is when the target object is at the detection position of the detector.

Thus, whether or not the target object is at the detection position can be detected based on a new threshold value before printing starts.

The control method of a printing device according to another aspect of at least one embodiment of the invention preferably also includes: comparing a previously set initial threshold value with a detection value acquired from the detector, and determining whether the target object is in the first state or the second state, before setting the threshold value; setting the threshold value if the target object is determined to be in the first state; and reporting if the target object is determined to be in the second state.

Thus, the threshold value can be correctly set by confirming before setting the threshold value that the target object is in the first state, or prompting the user to set the target object to the first state position.

Further preferably, the threshold value is ½ of the difference between the first detection value and the second detection value.

Thus comprised, the threshold value can be set by acquiring ½ the difference between the second detection value and the first detection value when the target object is not at the detection position, and the presence of the target object can be detected by comparing the threshold value with the detection value acquired from the detector.

Further preferably in the control method of a printing device according to another aspect of at least one embodiment of the invention, the detector is a transmissive photosensor including an emitter and a detector that detects light emitted from the emitter; and the first detection value is the light detection level of the detector when the emitter emits, and the second detection value is the light detection level of the detector when the emitter does not emit.

Thus, the threshold value can be set based on the light detection level when the emitter emits, and the light detection level when the emitter does not emit.

Further preferably in the control method of a printing device according to another aspect of at least one embodiment of the invention, printing the target object starts when the first state is detected based on the detection value from the detector.

Thus, printing on the target object starts when it is determined that a target object is not at the detection position, and the target object jams, for example, can be prevented.

In the control method of a printing device according to another aspect of at least one embodiment of the invention, the target object is a label that is printed and then peeled from a continuous liner at the exit.

Thus, whether or not a label, which is the target object, is present at the detection position can be detected based on a new threshold value.

A control method of a printing device according to another aspect of at least one embodiment of the invention preferably also includes peeling the label from the liner by a peeler mechanism disposed to the conveyance path upstream from the detector.

Thus, a label is peeled from the liner by the peeler mechanism, and whether or not the label was removed from the liner can be detected at the detection position of the detector.

Another aspect of at least one embodiment of the invention is a printing device including: a print unit that prints on a target object; a detector that detects the target object; and a control unit that sets a threshold value based on a first detection value and a second detection value acquired from the detector when the target object is in a first state, compares the threshold value with a detection value acquired from the detector and determines if the target object is in a first state or a second state, and sets the threshold value before starting printing to the target object.

By setting a new threshold value before printing starts, this aspect of the invention can set the threshold value appropriately to the ambient environment when printing starts.

Another aspect of at least one embodiment of the invention is a program that causes a control unit of a printing device to execute steps including: setting a threshold value based on a first detection value and a second detection value acquired from a detector when a target object is in a first state; comparing a detection value acquired from the detector with the threshold value and determining whether the target object is in a first state or a second state; and setting the threshold value before starting printing to the target object.

By setting a new threshold value before printing starts, the control unit in this aspect of the invention can set the threshold value appropriate to the ambient environment when printing starts.

Other objects and attainments together with a fuller understanding of the invention will become apparent and appreciated by referring to the following description and claims taken in conjunction with the accompanying drawings.

DESCRIPTION OF EMBODIMENTS

A preferred embodiment of the present invention is described below with reference to the accompanying figures. This embodiment describes a label printer as an example of a printing device according to the invention.

Figure 1:
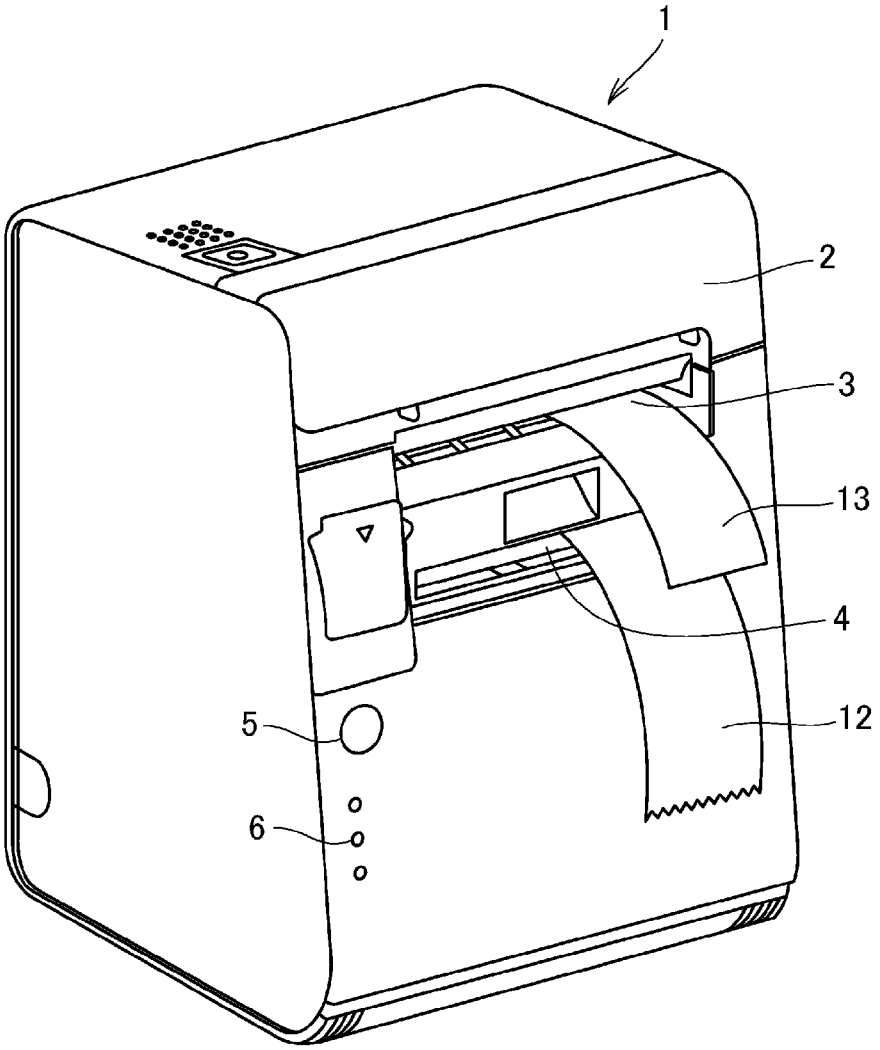
FIG. 1 is an external oblique view of a printing device.
Figure 2:
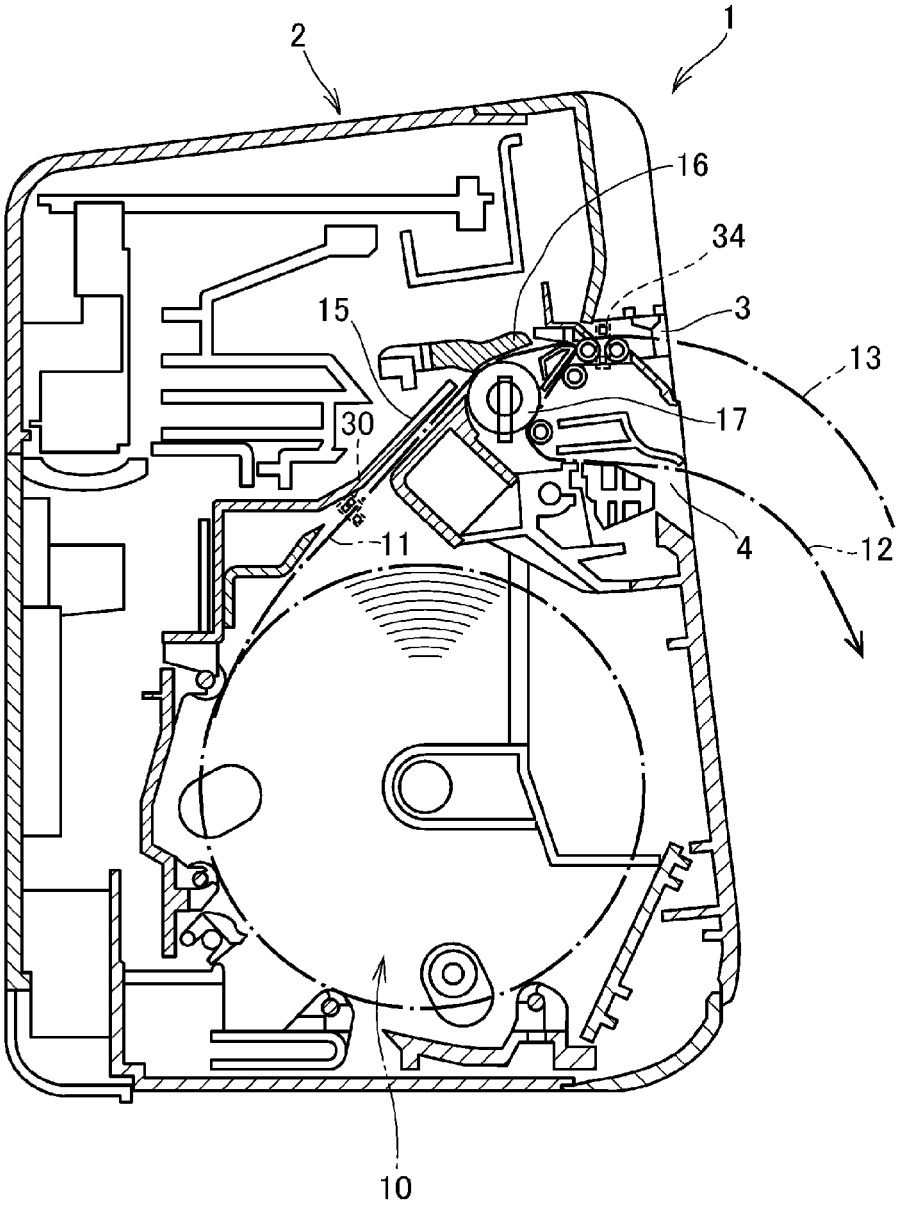
FIG. 2 is aside section view showing the internal configuration of the printing device.
Figure 3:
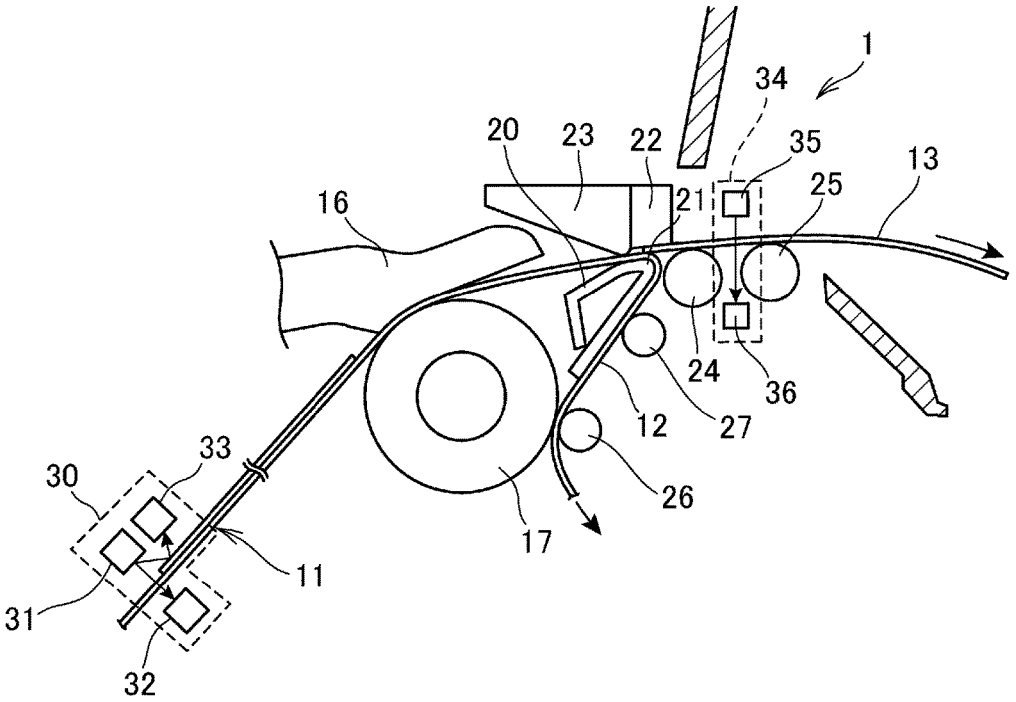
FIG. 3 is a section view showing main parts of the printing device.

FIG. 1 is an external oblique view of a label printer 1 as an example of a printing device according to the invention, FIG. 2 is a basic section view showing the internal configuration of the label printer 1, and FIG. 3 is an enlarged view of a portion of the internal configuration.

The label printer 1 has a basically rectangular box-like printer case 2 has a height that is greater than the width and depth. A label exit 3 (media exit) is formed at the top front part of the printer case 2, and a liner exit 4 is formed below the label exit 3.

A paper feed button 5 and a plurality of LED indicators 6 for reporting printer status information are disposed in the front of the printer case 2.

Figure 4:
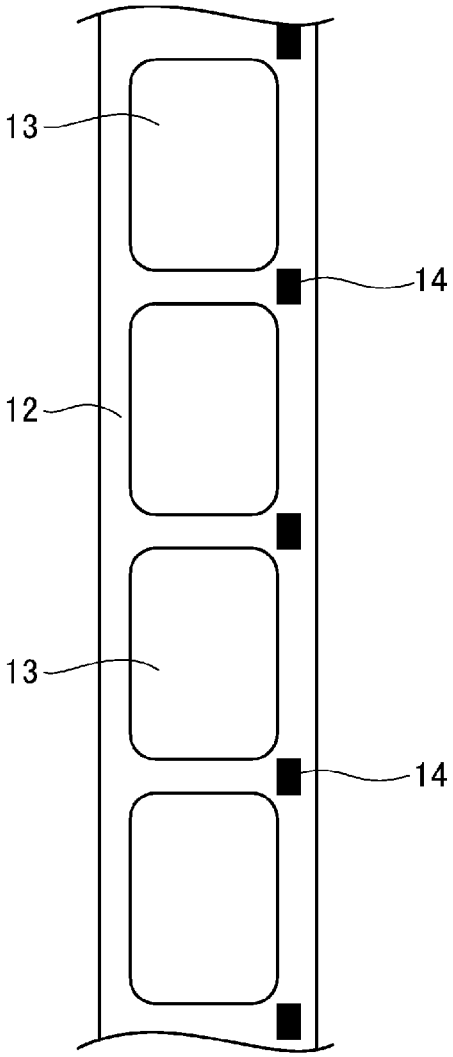
FIG. 4 illustrates the roll paper.

As shown in FIG. 2, a roll paper compartment 10 is formed in the inside bottom part of the printer case 2, and a roll paper 11 of label paper wound into a roll is loaded in the roll paper compartment 10. The roll paper 11 has peelable labels 13 affixed at a constant interval to one side of a continuous liner 12 of a specific width. In this embodiment of the invention as shown in FIG. 4, black marks 14 for determining the position of a label 13 are formed between the labels 13 on the one side of the liner 12.

Above the roll paper compartment 10 inside the printer case 2 is a roll paper guide 15 that guides the roll paper 11 diagonally up to the front of the printer case 2. A thermal head 16 is disposed near the top end of the roll paper guide 15. The thermal head 16 is a print unit for printing on the labels 13 of the roll paper 11, and is disposed with the printing side of the thermal head 16 facing the labels 13. A platen roller 17 that is pressed to the printing surface of the thermal head 16 is disposed at a position opposite the thermal head 16. The platen roller 17 is driven rotationally by a drive motor 18 (see FIG. 5). The roll paper 11 passes the roll paper guide 15 and is conveyed between the thermal head 16 and platen roller 17.

As shown in FIG. 2 and FIG. 3, a liner curvature guide 20, which is part of a peeler (separating) mechanism, is disposed on the downstream side of the thermal head 16 in the conveyance direction of the roll paper 11. The liner curvature guide 20 has a curved part 21 around which the downstream leading end of the liner 12 curves through an acute angle. A liner pressure guide 22 is disposed above the curved part 21 of the liner curvature guide 20 with a specific gap between the liner pressure guide 22 and the curved part 21. The gap between the top end part of the curved part 21 and the liner pressure guide 22 is slightly greater than the combined thickness of the liner 12 and a label 13.

A liner pusher 23 disposed to the liner curvature guide 20 on the upstream side of the curved part 21 in the conveyance direction of the liner 12 causes the liner 12 conveyed toward the curved part 21 to bend toward the liner curvature guide 20 side. As a result, the liner 12 is guided to the curved part 21 of the liner curvature guide 20 while being pushed down and bent slightly to the liner curvature guide 20 side by the liner pusher 23, and curves in an acute angle around the curved part 21. Because only the liner 12 behind the printed label 13 is bent in an acute angle by the curved part 21 of the liner curvature guide 20, the printed label 13 affixed to the surface of the liner 12 is peeled from the liner 12 and issued from the label exit 3.

A label feed roller 24 is freely rotatably disposed near the downstream side of the curved part 21 in the conveyance direction of the peeled label 13. The top part of the outside surface of the label feed roller 24 is on substantially the same plane as the guide surface of the liner pressure guide 22.

A label guide roller 25 that guides the label 13 peeled from the liner 12 to the label exit 3 is disposed freely rotatably near the label feed roller 24 on the label exit 3 side. The label guide roller 25 is disposed at substantially the same height as the label feed roller 24.

A peeler roller 26 is disposed to push against the outside surface of the platen roller 17 on the opposite side of the platen roller 17 as the thermal head 16. Rotationally driving the platen roller 17 also rotationally drives the peeler roller 26. The liner 12 held between the platen roller 17 and peeler roller 26 is conveyed by rotationally driving the platen roller 17 and peeler roller 26. This operation guides the liner 12 from between the platen roller 17 and peeler roller 26 toward the front of the label printer 1, and discharges the liner 12 from the liner exit 4 to the front of the label printer 1.

A power transfer roller 27 opposing the bottom side of the liner curvature guide 20 is disposed freely rotatably below the liner curvature guide 20 at a position on the downstream side in the conveyance direction of the liner 12 from the curved part 21. The liner 12 is held between the liner curvature guide 20 and the power transfer roller 27, and when the liner 12 is conveyed between the platen roller 17 and peeler roller 26 as described above, the power transfer roller 27 is driven rotationally in conjunction with conveyance of the liner 12.

The power transfer roller 27 is connected to the label feed roller 24 through a power transfer mechanism such as a gear train not shown, and when the power transfer roller 27 is rotationally driven, the label feed roller 24 is rotationally driven in the direction conveying the label 13 to the label exit 3.

In this embodiment of the invention as shown in FIG. 3, a first detector 30 is disposed on the upstream side of the thermal head 16 in the conveyance direction of the liner 12. The first detector 30 has a first emitter 31 that uses an LED, for example. The first detector 30 also includes a first transmissive photodetection unit 32 disposed opposite the first emitter 31 with the roll paper 11 therebetween, and a reflective photodetection unit 33 disposed on the same side of the roll paper 11 as the first emitter 31.

The first transmissive photodetection unit 32 receives and detects the light emitted from the first emitter 31, and the position of a label 13 on the liner 12 is detected based on the detection value of light (the amount of light) detected by the first transmissive photodetection unit 32.

The reflective photodetection unit 33 is used to detect the black marks 14 on the roll paper 11. Light is emitted from the first emitter 31 to the side of the roll paper 11 having the areas where the black marks 14 are formed, the reflection of the emitted light is detected by the reflective photodetection unit 33, and whether or not a black mark 14 is present is detected based on the detection value.

A second detector 34 is disposed in the conveyance direction of the label 13 on the downstream side of the liner curvature guide 20 and the upstream side of the label exit 3. This second detector 34 is a detector such as a transmissive photodetection unit including a second emitter 35 that emits light and a second transmissive photodetection unit 36 as the detection unit disposed opposite the second emitter 35 with the label 13 therebetween. The emitter of the second detector 34 may also be an LED, for example.

The second transmissive photodetection unit 36 detects light emitted from the second emitter 35. A first state in which a label 13 is not at the detection position of the second detector 34, or a second state in which a label 13 is at the detection position of the second detector 34, is detected based on the detection value of light detected by the second transmissive photodetection unit 36. Note that the label 13 detected by the second detector 34 is a label 13 that has been peeled from the liner 12.

Figure 5:
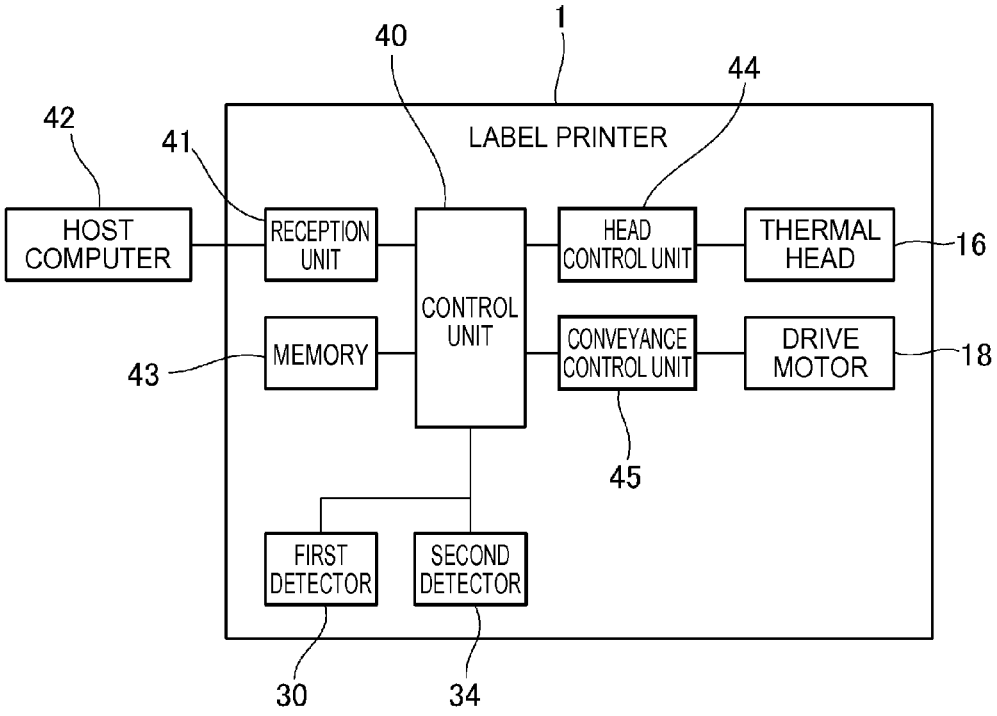
FIG. 5 is a block diagram showing the control system of the printing device.

FIG. 5 is a block diagram illustrating the control configuration of the label printer 1 in this embodiment of the invention.

The label printer 1 has a control unit 40 that controls other parts of the label printer 1. The control unit 40 is a processor such as a CPU.

A reception unit 41 is connected to the control unit 40. The reception unit 41 receives print data sent by wire or wirelessly from a host computer 42, and passes the received print data to the control unit 40.

The control unit 40 stores the print data sent from the reception unit 41 in memory 43 converted to data for each pixel. Note that the memory 43 is also a storage unit that stores, for example, initial factory-setting threshold values or other data required for control.

Based on the print data stored in memory, the control unit 40 outputs drive control signals for driving the head control unit 44 that controls driving the thermal head 16, and for driving the conveyance control unit 45 that controls the drive motor 18 that drives the platen roller 17.

The control unit 40 controls turning the first detector 30 and second detector 34 on and off, and acquires the detection values output from the first detector 30 and second detector 34. The control unit 40 determines the position of a label 13 on the conveyed liner 12 by evaluating the light detection level of the first detector 30 based on the detection value sent from the first transmissive photodetection unit 32 or the reflective photodetection unit 33 of the first detector 30.

More specifically, the position of a conveyed label 13 can be detected based on the detection value output from the first transmissive photodetection unit 32 because the detection value is different in the following situations: (1) when there is nothing at the detection position, (2) when only the liner 12 is at the detection position, and (3) when a label 13 is affixed to the liner 12 at the detection position.

The position of a conveyed label 13 can also be detected based on the detection value of the reflective photodetection unit 33, which differs when a part other a black mark 14 on the liner 12 is at the detection position, and when a black mark 14 denoting a label 13 is at the detection position.

The control unit 40 indexes the label 13 to the start printing position of the thermal head 16 by outputting a drive control signal to the conveyance control unit 45 based on the position of the label 13 determined from the detection value from the first detector 30.

The control unit 40 also determines whether or not a label 13, which is the detection target in this example, is at the detection position of the second detector 34 by evaluating the light detection level of the second detector 34 based on the detection value sent from the second transmissive photodetection unit 36 of the second detector 34.

More specifically, whether or not a conveyed label 13 is present can be determined because the detection value of the second transmissive photodetection unit 36 is different in the first state when a label 13 is not at the detection position of the second detector 34, and the second state when a label 13 is at the detection position. More specifically, when the threshold value of the light detection level is set based on the detection value of the second detector 34, the control unit 40 determines a label 13 is not present when the light detection level of the second transmissive photodetection unit 36 equals or exceeds the threshold value, and determines a label 13 is present when the light detection level is less than the threshold value.

The detection value is the output value output when light is detected by the first transmissive photodetection unit 32 or reflective photodetection unit 33 of the first detector 30, and when light is detectedby the second transmissive photodetection unit 36 of the second detector 34. The light detection level is an index used for comparison with the threshold value by the control unit 40 based on the detection value.

The control unit 40 can determine that the label 13 was peeled appropriately from the liner 12 when a label 13 is determined to be present at the label exit 3, and determine that the label 13 was not peeled from the liner 12 when a label 13 is not present at the label exit 3. The control unit 40 can also decide that the user removed the label 13 when it determines a label 13 is not present after determining that the label 13 was appropriately peeled from the liner 12.

Because the second detector 34 is disposed at the label exit 3, the light detection level of the second transmissive photodetection unit 36 may be high as a result of external light noise, for example. As a result, the control unit 40 may erroneously determine that a label 13 was not peeled even though the label 13 was already peeled from the liner 12.

The control unit 40 in this embodiment of the invention therefore acquires both a first detection value for light incident on the second transmissive photodetection unit 36 when the second emitter 35 of the second detector 34 emits, and a second detection value for light incident on the second transmissive photodetection unit 36 when the second emitter 35 does not emit. Next, the control unit 40 sets a new threshold value as a replacement for the current threshold value based on the light detection level at the first detection value, and the light detection level at the second detection value.

More specifically, the control unit 40 calculates the difference between the light detection level of the first detection value and the light detection level of the second detection value, and sets the new threshold value at ½ of this difference between the light detection level of the first detection value and the light detection level of the second detection value.

Note that the present invention is not limited to setting the threshold value is not limited to ½ of the difference between the light detection levels of the two detection values, and the threshold value may be set based on past statistics.

The threshold value is set in this embodiment of the invention based on when print data is sent from the host computer 42 to the reception unit 41 and the process of printing one label 13 starts. By setting the threshold value at this timing, a threshold value based on the current amount of external light noise can be set immediately before starting to print a label 13. Note that if print data sent from the host computer 42 is temporarily stored in memory 43, and the print data is then read from memory 43 for printing, the threshold value may be set based on the time of reading the print data from memory 43 and starting to print the one label 13.

When the control unit 40 determines that a label 13 is not at the detection position of the second detector 34 based on the detection value from the second detector 34, the control unit 40 starts printing a label 13. By sending drive control signals to the head control unit 44 and conveyance control unit 45, the control unit 40 rotationally drives the platen roller 17 and drives the thermal head 16. As a result, a label 13 is printed.

When printing ends, and a label 13 is in the second state at the detection position of the second detector 34, the control unit 40 receives the detection value of light incident to the second transmissive photodetection unit 36 when the second emitter 35 of the second detector 34 emits light. The control unit 40 then compares the acquired detection value with the set threshold value, and determines if a label is present at the detection position.

Figure 6:
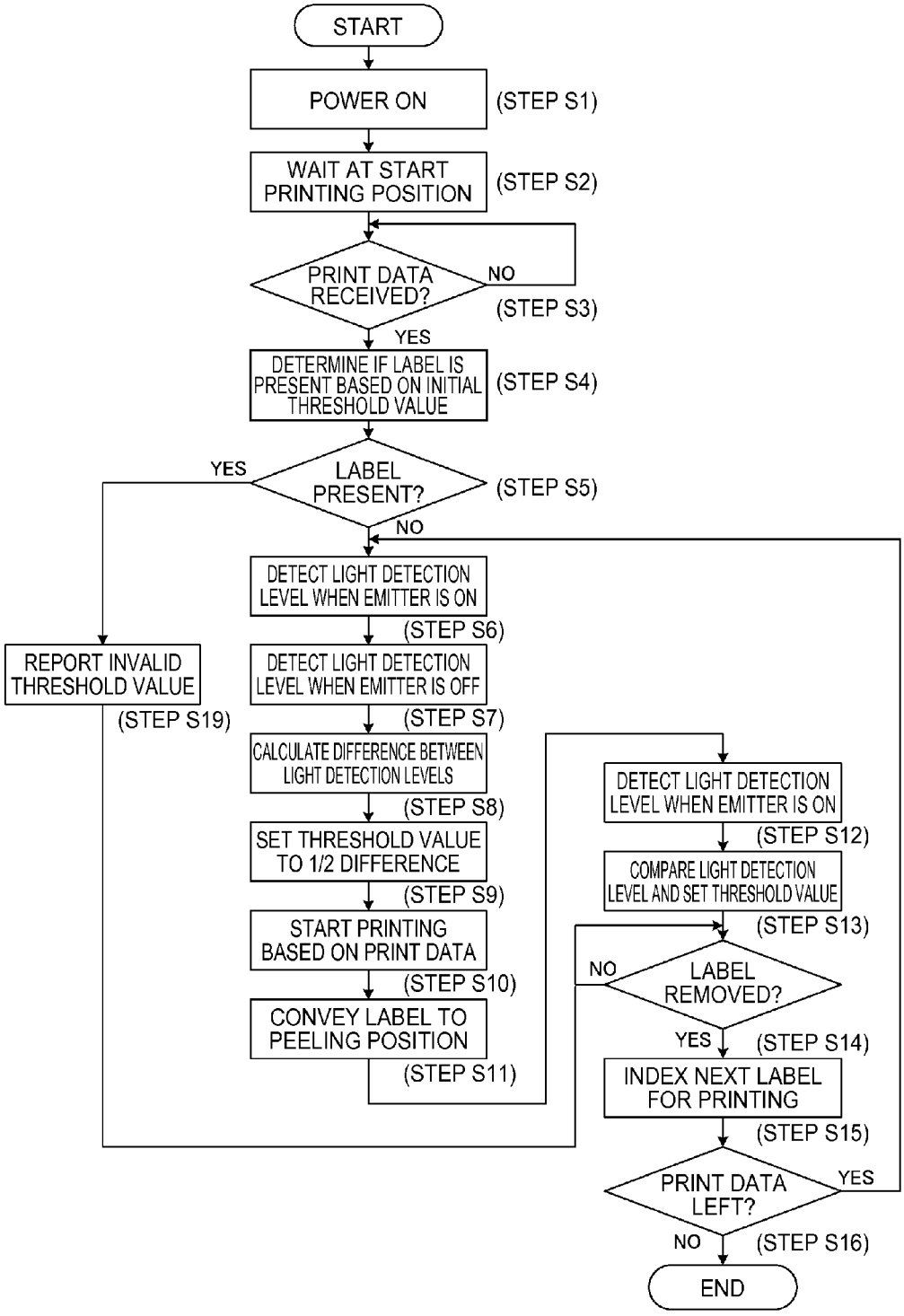
FIG. 6 is a flow chart showing the operation of the printing device.

A control method of the printing device described above is described next with reference to the flow chart in FIG. 6. Note that the control method of the printing device can be based on a program causing the control unit 40 to execute a process.

When the label printer 1 turns on in this embodiment of the invention (step S1), the control unit 40 waits with the label 13 at the start printing position (step S2). When the label 13 is at the start printing position, the leading end of the label 13 is between the thermal head 16 and platen roller 17. When the label printer 1 turns on, the first operation is for the control unit 40 to convey the label 13 to the start printing position and then wait (indexing process).

When the reception unit 41 then receives print data (step S3 returns YES), the control unit 40 uses the initial threshold value (such as the default threshold value set at the factory) to determine if a label 13 is at the detection position of the second detector 34 (step S4). If a label 13 is at the detection position of the second detector 34 (step S5 returns YES), the control unit 40 determines that the threshold value is not correctly set and drives an LED indicator 6, for example, to report the same (step S19).

If a label 13 is not at the detection position of the second detector 34 (step S5 returns NO), the control unit 40 receives the light detection level when the second emitter 35 of the second detector 34 emits (step S6), and then receives the light detection level when the second emitter 35 does not emit (step S7).

Next, the control unit 40 calculates the difference between the light detection level when the second emitter 35 emits and the light detection level when the second emitter 35 does not emit (step S8). The control unit 40 then sets ½ of the calculated difference as the new threshold value (step S9).

After the threshold value is set, the control unit 40 sends drive control signals based on the print data to the head control unit 44 and conveyance control unit 45. The control unit 40 outputs a drive control signal to rotationally drive the platen roller 17, drive the thermal head 16, and start the label 13 printing process (step S10).

When printing the label 13 ends, the control unit 40 drives the platen roller 17 to convey the label 13 and liner 12 (step S11). The conveyed label and liner 12 are conveyed with the liner 12 curving through an acute angle around the curved part 21 of the liner curvature guide 20, thereby peeling the label 13 from the liner 12. The peeled label 13 is then discharged from the label exit 3. The output label 13 is then held by the label guide roller 25 and label feed roller 24 at the detection position of the second detector 34 at the label exit 3.

The control unit 40 then acquires the light detection level when the second emitter 35 of the second detector 34 emits (step S12).

The control unit 40 determines whether a label 13 is at the detection position by comparing the light detection level when the second emitter 35 emits with a set threshold value (step S13). More specifically, if the light detection level of the second detector 34 is equal to or greater than the threshold value, a label 13 is determined to not be at the detection position of the second detector 34, and a label 13 is determined to be at the detection position if the light detection level is below the threshold value.

Whether or not the label was removed from the label exit 3 is then determined based on the second detector 34 (step S14). If the second detector 34 detects that the label was removed (step S14 returns YES), the next label 13 is indexed to the start printing position to wait for print data (step S15). If print data is buffered to memory 43, for example, the control unit 40 determines if there is any print data remaining in memory 43 (step S16). If print data is in memory 43 (step S16 returns YES), the control unit 40 obtains the light detection level when the second emitter 35 of the second detector 34 emits (step S6), and the operation repeats from step S16. If there is no print data in memory 43 (step S16 returns NO), the control unit 40 ends the process.

As described above, because a new threshold value is set before printing starts, this embodiment of the invention can set a threshold value appropriate to the ambient operating environment at the time printing starts. More specifically, a threshold value can be set appropriately to the operating environment immediately before the label printer 1 is used, thus assuring an appropriate threshold value even if the label printer 1 has moved to a new location or the label printer 1 is used at a different time of day under different lighting conditions, for example.

The invention is not limited to the foregoing embodiment, and can be changed and modified in many ways without departing from the scope of the accompanying claims.

For example, the printing device of the invention is described with reference to a label printer 1 having a thermal head 16, but the invention is not so limited and can be used with other types of printers, including inkjet printers.

The invention being thus described, it will be apparent that it may be varied in many ways. Such variations are not to be regarded as a departure from the spirit and scope of the invention, and all such modifications as would be apparent to one skilled in the art are intended to be included within the scope of the following claims.

What is claimed is:

1. A control method of a printing device comprising a transmissive photosensor including an emitter and a detector that detects light emitted from the emitter, the method comprising:

setting a threshold value based on a first detection value and a second detection value acquired from the detector, when a target object is not at a detected position;

comparing the threshold value with a third detection value acquired from the detector; and determining whether or not the target object is at the detected position; wherein, the setting the threshold value occurs at a time when printing starts on the target object, the first detection value is the light detection level of the detector when the emitter emits, and the second detection value is the light detection level of the detector when the emitter does not emit light.

2. The control method of a printing device described in claim 1, further comprising:

setting the threshold value occurs after the printing device receives print data related to printing on the target object.

3. The control method of a printing device described in claim 1, wherein:

the detector detects the target object at an exit of a conveyance path in which the target object is conveyed.

4. The control method of a printing device described in claim 1, further comprising:

determining whether or not the target object is at the detection position, before the setting the threshold value occurs; and when the target object is not at the detection position, the setting the threshold value occurs; and when the target object is at the detection position, reporting that threshold value is not correctly set.

5. The control method of a printing device described in claim 1, further comprising:

starting printing of the target object when the target object is determined to be at the detected position, after the setting the threshold value.

6. The control method of a printing device described in claim 3, wherein:

the target object is a label peeled from a continuous liner at the exit.

7. A printing device comprising:

a print head that prints on a target object;

a transmissive photosensor including an emitter and a detector configured to detect light emitted from the emitter; and a processor configured to set a threshold value based on a first detection value and a second detection value, before starting printing by the print head, the first detection value and the second detection value are acquired from the detector when the target object is not at a detected position, to compare the threshold value with a third detection value acquired from the detector, and to determine whether or not the target object is at the detection position, wherein, the first detection value is the light detection level of the detector when the emitter emits, and the second detection value is the light detection level of the detector when the emitter does not emit light.

8. A non-transitory storage medium storing a program causing a processor of a printing device, comprising transmissive photosensor including an emitter and a detector that detects light emitted from the emitter, to steps comprising:

setting a threshold value based on a first detection value and a second detection value acquired from the detector when a target object is not at a detected position;

comparing a third detection value acquired from the detector with the threshold value; and determining whether or not the target object is at the detected position; wherein the setting the threshold value occurs before starting printing on the target object, the first detection value is the light detection level of the detector when the emitter emits, and the second detection value is the light detection level of the detector when the emitter does not emit.

* * * * *